US008721109B2

(12) United States Patent
Lin

(10) Patent No.: US 8,721,109 B2
(45) Date of Patent: May 13, 2014

(54) POWER SAVING LAMP

(75) Inventor: Sheng-Lian Lin, Taoyuan (TW)

(73) Assignees: Sheng-Lian Lin, Taoyuan County (TW); Yu-Ying Lin, Taoyuan County (TW)

( * ) Notice: Subject to any disclaimer, the term of this patent is extended or adjusted under 35 U.S.C. 154(b) by 0 days.

(21) Appl. No.: 13/550,612

(22) Filed: Jul. 17, 2012

(65) Prior Publication Data

US 2014/0022772 A1 Jan. 23, 2014

(30) Foreign Application Priority Data

Dec. 21, 2011 (CN) ..... 2011 2 0539916

(51) Int. Cl.
*F21L 4/00* (2006.01)

(52) U.S. Cl.
USPC ..... 362/183; 362/186; 362/194; 362/362

(58) Field of Classification Search
None
See application file for complete search history.

(56) References Cited

U.S. PATENT DOCUMENTS

| | | | | |
|---|---|---|---|---|
| 3,774,023 | A * | 11/1973 | Cobarg et al. | 362/183 |
| 7,429,827 | B2 * | 9/2008 | Richmond | 315/149 |
| 2013/0039081 | A1 * | 2/2013 | Czipri et al. | 362/477 |
| 2013/0107545 | A1 * | 5/2013 | Tai et al. | 362/363 |

* cited by examiner

*Primary Examiner* — Ashok Patel
(74) *Attorney, Agent, or Firm* — Leong C. Lei

(57) ABSTRACT

A power saving lamp includes a base, a cover, a light source and a solar cell. The cover is fixed on the base. The light source is arranged on the base and inside the cover. The solar cell is arranged on the base or the cover and close to the light source. The solar cell can convert the solar power into electric power for further use to realize the use of driving the light source to emit light. The utilization efficiency of the light from the light source can be improved and the electric power can be saved. Besides, when the solar cell is closer to the light source, the photoelectric converting efficiency of the solar cell is higher and the recycle of the light can be realized. The utilization efficiency of the light from the light source can be further improved and the electric power can be saved.

2 Claims, 4 Drawing Sheets

POWER SAVING LAMP

BACKGROUND OF THE DISCLOSURE a) Field of the Disclosure

The present disclosure relates to a lamp, in particularly to a power saving lamp.

b) Brief Description of the Related Art

Incandescent light bulb becomes a necessity in our daily life since it is invented. Nowadays, it is used not only in nighttime, but in daytime in many dark places or public places, so consequently the electrical power consumption is remarkably increased.

However, a certain amount of light from the light bulb may be projected toward unwanted directions. Although a lampshade can be used to reflect the light and reuse it, the utilization efficiency of the light is still low and causes unnecessary waste of electrical power.

SUMMARY OF THE DISCLOSURE

The present disclosure aims to solve the technical problem and improve the utilization efficiency of the light of the light bulb.

For achieving the above object, the present disclosure provides a power saving lamp, which includes a base, a cover, a light source and a solar cell. The cover is fixed on the base. The light source is arranged on the base and inside the cover. The solar cell is arranged on the base or the cover.

Moreover, the light source is an incandescent light bulb, the cover is of inverted bowl shape, and the solar cell is arranged on an upper portion, a lower portion or a peripheral of the inner surface of the cover.

Moreover, the light source is a fluorescent lamp, the base is of rectangular shape or stripe shape, the fluorescent lamp is transversely arranged on the base, and the solar cell is arranged on an inner surface of the base.

Moreover, the base is of rectangular shape and the cover is of pyramid shape.

According to embodiments of the present disclosure, the solar cell is arranged on the base or the cover and close to the light source. The solar cell can convert the solar power irradiated thereon into electric power for further use. The electric power can supply the light source to realize the use of driving the light source to emit light. The utilization efficiency of the light from the light source can be improved and the electric power can be saved. Besides, since the lumen value is inversely proportional to the distance from the light source, when the solar cell is closer to the light source, the photoelectric converting efficiency of the solar cell is higher and the luminous power can be completely used and the recycle of the light form the light source can be realized. The utilization efficiency of the light from the light source can be further improved and the electric power can be saved.

BRIEF DESCRIPTION OF THE DRAWINGS

The drawings disclose illustrative embodiments of the present disclosure. They do not set forth all embodiments. Other embodiments may be used in addition or instead. Details that may be apparent or unnecessary may be omitted to save space or for more effective illustration. Conversely, some embodiments may be practiced without all of the details that are disclosed. When the same numeral appears in different drawings, it refers to the same or like components or steps.

Aspects of the disclosure may be more fully understood from the following description when read together with the accompanying drawings, which are to be regarded as illustrative in nature, and not as limiting. The drawings are not necessarily to scale, emphasis instead being placed on the principles of the disclosure.

DETAILED DESCRIPTION OF THE INVENTION

The detail of the present disclosure is described below by presenting embodiments with accompanying drawings. It should be understood that the scope of the present disclosure is not limited by the embodiments.

Figure 1:
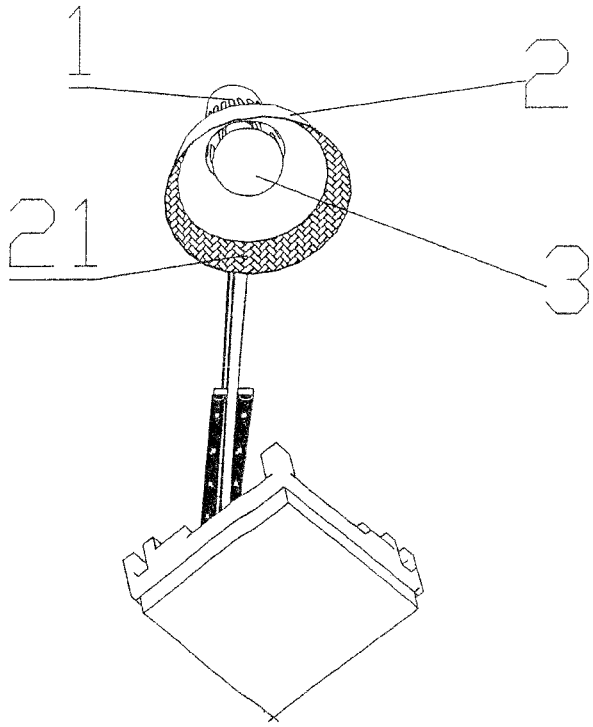
FIG. 1 is a perspective view of the power saving lamp according to the first embodiment of the present disclosure.
Figure 2:
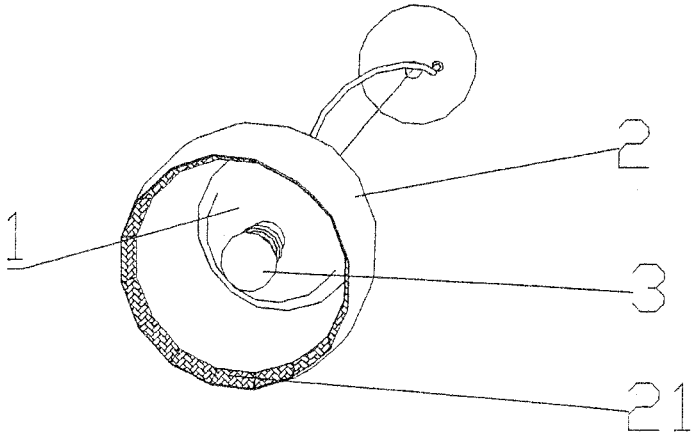
FIG. 2 is a perspective view of the power saving lamp according to the second embodiment of the present disclosure.
Figure 3:
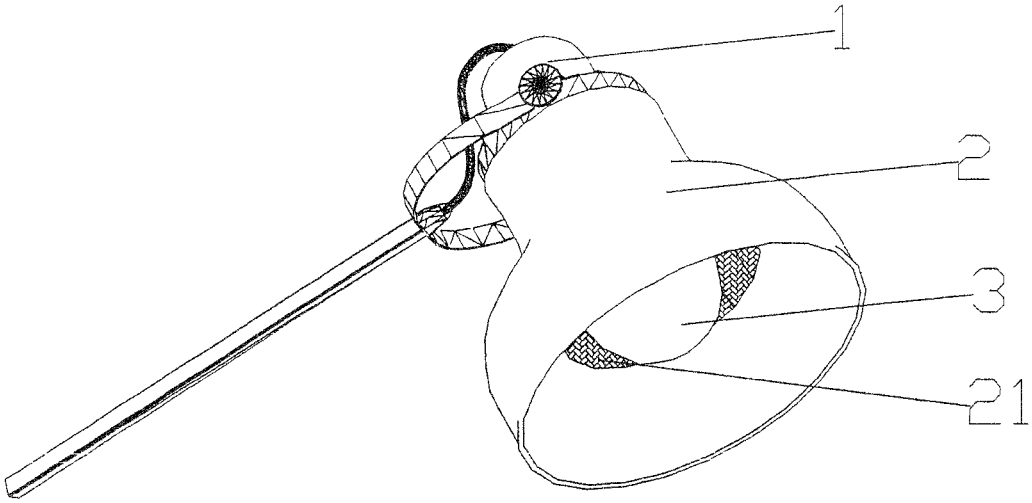
FIG. 3 is a perspective view of the power saving lamp according to the third embodiment of the present disclosure.
Figure 4:
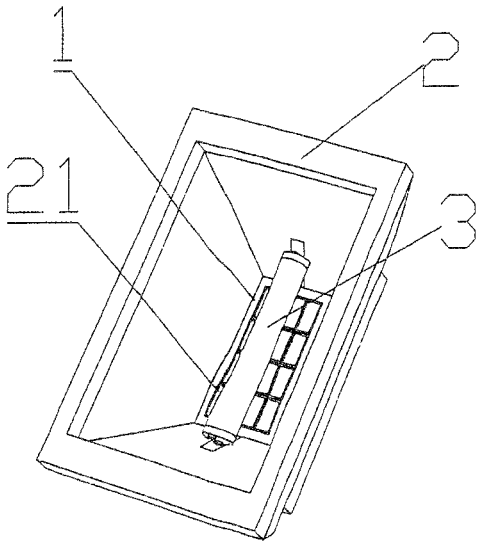
FIG. 4 is a perspective view of the power saving lamp according to the fourth embodiment of the present disclosure.
Figure 5:
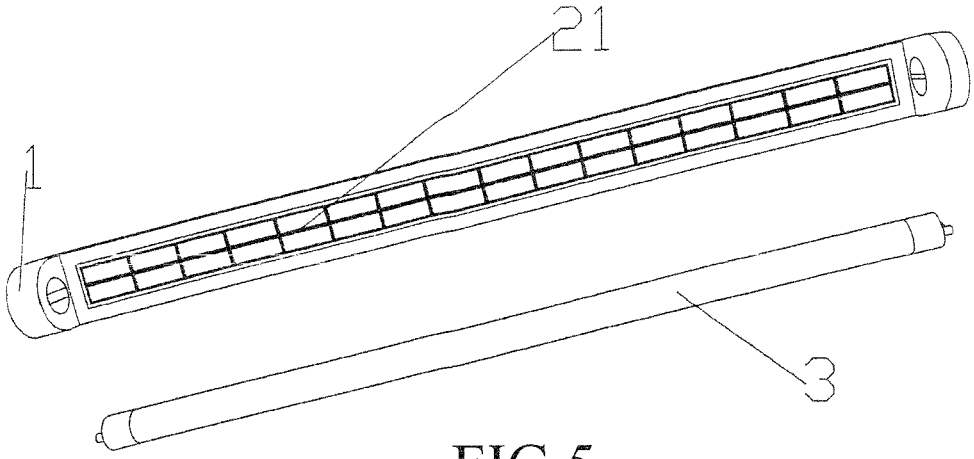
FIG. 5 is an exploded view of the power saving lamp according to the fifth embodiment of the present disclosure.
Figure 6:
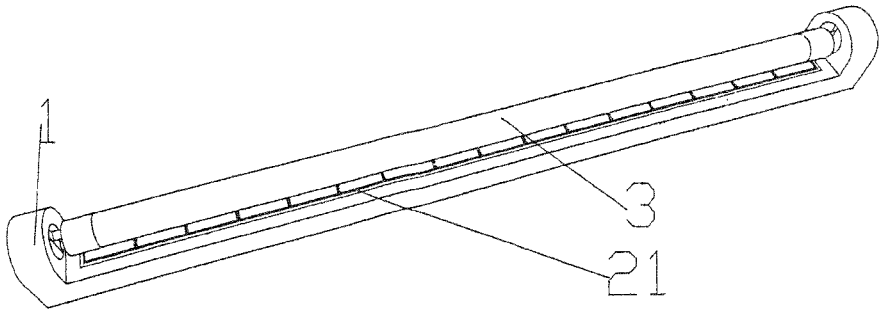
FIG. 6 is a perspective view of the power saving lamp according to the fifth embodiment of the present disclosure.

Referring to FIG. 1 to FIG. 6, the power saving lamp is an incandescent light bulb apparatus or a fluorescent lamp apparatus, which includes a base 1, a cover 2 and a light source 3. As shown in FIG. 1 to FIG. 3, when the power saving lamp is an incandescent light bulb apparatus, the cover 2 is of inverted bowl shape, the bottom of the cover 2 is fixed to the base 1. The light source 3 is an incandescent light arranged on the base 1 and inside the cover 2. Besides, a ring shaped solar cell 21 is arranged on the inner surface of the cover 2. The ring shaped solar cell 21 is arranged on an upper portion, a lower portion or a peripheral of the inner surface of the cover 2. As shown in FIG. 4 to FIG. 6, when the power saving lamp is a fluorescent lamp apparatus, the base 1 is of rectangular shape or stripe shape. The light source 3 is a fluorescent lamp tube, which is arranged on the base 1 and inside the cover 2. A rectangular shaped solar cell 21 is arranged on an inner surface of the base 1. When the base 1 is of strip shape, the cover 2 can be omitted. The light source 3 is a fluorescent lamp, which is directly arranged to the base 1. Similarly, a rectangular shaped solar cell 21 is arranged on an inner surface of the base 1.

Figure 7:
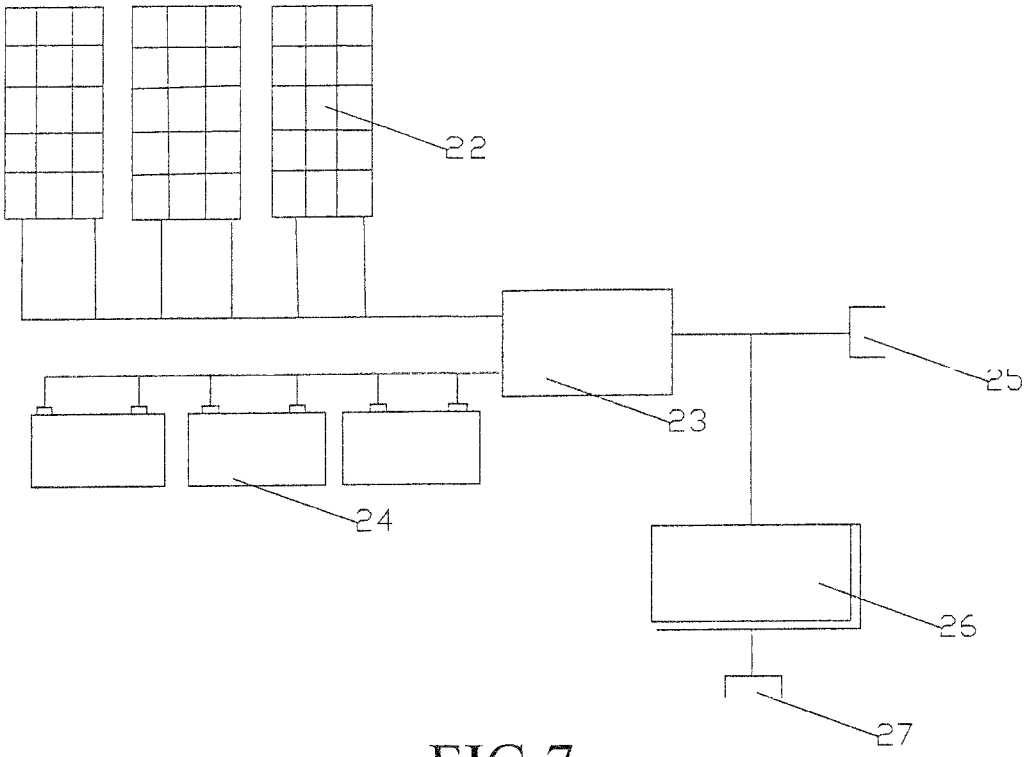
FIG. 7 is a perspective view of the solar cell of the power saving lamp of the present disclosure.

As FIG. 7 shows, the solar cell 21 is an assembly including a plate and several solar cell components arranged on the plate. The solar cell components include a solar cell set 22, a solar cell controller 23, and a battery 24. The solar cell set 22 can convert the solar power into electric power. A direct current generated thereby can be transformed by an inverter 26 into an alternating current, and then supply the original circuit of the lamp apparatus through the AC output end 27 in a manner of serial connection or parallel connection. Alternatively, it can be directly stored in the battery 24 and then transformed by the inverter 26 into an alternating current for the original electrical machine through the AC output end 27. Alternatively, it can be supplied to a DC electrical machine through the DC output end 25. The specific functions of the components are respectively described below.

The solar cell set 22 is a core portion of the solar power system and the most valuable portion of the solar power system. It is used for converting the solar power into electrical power, which can be stored in a battery or used for driving an electrical load. The quality and the cost of whole system are directly determined by the quality and the cost of the solar cell set.

The solar cell set 22 is made of silicon in the nature world, and a p-type semiconductor and an n-type semiconductor are made for a positive electrode and a negative electrode, respectively. The solar power is absorbed by the two semiconductors and an electrical voltage is generated therefrom as a battery. When the light of the light source is illuminated onto the semiconductor p-n junction of the solar cell set 22, newly electron hole pairs are generated. Driven by the electric field of the p-n junction, the holes flow from the n-type zone to the p-type zone and the electrons flow from the p-type zone to the n-type zone. An electric current is formed after the circuit is connected. That is the working theory of the solar cell.

The solar cell controller 23 is used for controlling the working status of the whole system. It can prevent the battery form over charging or discharging. In the circumstance of high temperature, the qualified controller still has the function of temperature compensation. Other additional functions like light sensitive controlling or time controlling switches can be added on the controller 23.

The battery 24 can be a lead-acid battery including two types of 12V and 24V. A nickel-metal hydride cell, a nickel-cadmium battery or a Lithium battery can also be used in a compact system. They can store the electric power generated by the solar cell and then release it when needed.

Inverter 26 is used in many situations for a 220V or 110V alternating current. The direct output of the solar cell is a 12 v, 24 v, 48 v direct current. In order to supply a 220 v electrical machine, the DC current generated by the solar power system is needed to be converted into an AC current. So a DC-AC converter is needed. In some circumstances, if the electrical loads are multiple types, a DC-DC converter may also be needed. For example, a 24 v DC current is converted into a 5 v DC current. It should be mentioned that is not a simple voltage regulating.

The solar cell 21 of the power saving lamp is arranged on the base 1 or the cover 2 and close to the light source 3. The solar cell 21 can convert the light power illuminated thereon into electric power for further use. The electric power can supply the light source 3 to realize the use of driving the light source 3 to emit light. The utilization efficiency of the light from the light source 3 can be improved and the electric power can be saved. Besides, since the lumen value is inversely proportional to the distance from the light source 3, when the solar cell 21 is closer to the light source 3, the photoelectric converting efficiency of the solar cell 3 is higher and the luminous power can be completely used and the recycle of the light form the light source 3 can be realized. The utilization efficiency of the light from the light source 3 can be further improved and the electric power can be saved.

Lumen is a primary technical indicator of a projector and a unit of luminous flux. The luminous flux is adjusted to reflect the varying sensitivity of the human eye to the radiation of light. The unit of luminous flux is the lumen (lm). It is also called brightness. Higher lumen value means brighter.

The scope of protection is limited solely by the claims, and such scope is intended and should be interpreted to be as broad as is consistent with the ordinary meaning of the language that is used in the claims when interpreted in light of this specification and the prosecution history that follows, and to encompass all structural and functional equivalents thereof.

What is claimed is:

1. A power saving lamp comprising:

a base;

a cover having an inverted bowl shape and having a bottom fixed to said base;

a light source arranged on said base and inside said cover; and a ring-shaped solar cell arranged on an inner surface of said cover;

wherein said solar cell is an assembly including a plate and a plurality of solar cell components arranged on said plate, said solar cell components including a solar cell set, a solar cell controller, and a battery, said solar cell set being used for converting solar power from said light source into electric power which is transformed by an inverter into alternating current for supplying power to said light source.

2. A power saving lamp comprising:

a rectangular base;

a rectangular cover having a bottom fixed to said rectangular base;

a fluorescent lamp transversely arranged on said base and inside said cover; and a rectangular solar cell arranged on an inner top of said cover;

wherein said solar cell is an assembly including a plate and a plurality of solar cell components arranged on said plate, said solar cell components including a solar cell set, a solar cell controller, and a battery, said solar cell set being used for converting solar power from said light source into electric power which is transformed by an inverter into alternating current for supplying power to said fluorescent lamp.

* * * * *